US007958875B2

(12) United States Patent
Tsubakino et al.

(10) Patent No.: US 7,958,875 B2
(45) Date of Patent: Jun. 14, 2011

(54) INTERNAL COMBUSTION ENGINE WITH BREATHER SYSTEM

(75) Inventors: Yukihiro Tsubakino, Saitama (JP); Hidemichi Mori, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 587 days.

(21) Appl. No.: 12/056,071

(22) Filed: Mar. 26, 2008

(65) Prior Publication Data

US 2008/0236553 A1 Oct. 2, 2008

(51) Int. Cl.
*F02B 47/08* (2006.01)

(52) U.S. Cl. ..... 123/572

(58) Field of Classification Search ..... 123/572–574, 123/41.86

See application file for complete search history.

(56) References Cited

U.S. PATENT DOCUMENTS

| | | | | |
|---|---|---|---|---|
| 4,651,704 | A * | 3/1987 | Sekiguchi | 123/572 |
| 6,758,197 | B2 * | 7/2004 | Korenjak et al. | 123/572 |
| 7,717,101 | B2 * | 5/2010 | Beetz et al. | 123/572 |
| 2002/0083933 | A1 * | 7/2002 | Schmid et al. | 123/572 |
| 2002/0174846 | A1 * | 11/2002 | Ashida et al. | 123/182.1 |
| 2007/0175458 | A1 * | 8/2007 | Hochmayr et al. | 123/572 |
| 2007/0215075 | A1 * | 9/2007 | Hutter et al. | 123/41.86 |

FOREIGN PATENT DOCUMENTS

WO WO-2005/005793 A 1/2005

* cited by examiner

*Primary Examiner* — M. McMahon

(74) *Attorney, Agent, or Firm* — Birch Stewart Kolasch & Birch, LLP

(57) ABSTRACT

An internal combustion engine including a valve system and a breather system. The valve system includes a camshaft having intake cams and exhaust cams. The intake cams open and close intake valves, and the exhaust cams open and close exhaust valves. The breather system includes an upstream-side breather chamber and a downstream-side breather chamber. Blow-by gas flows into the upstream-side breather chamber through a chain chamber. The down-stream side breather chamber is provided in the camshaft, and also formed of a through hole constituted of a plurality of hole portions. The hole portions have different sizes and are aligned in the axial direction. The through hole opens to the chain chamber at a first shaft end portion of the camshaft, and also opens to the down-stream side breather chamber at a second shaft end portion of the camshaft. The down-stream side breather chamber is formed of a cam holder.

20 Claims, 3 Drawing Sheets

INTERNAL COMBUSTION ENGINE WITH BREATHER SYSTEM

CROSS-REFERENCE TO RELATED APPLICATION

The present application claims priority under 35 U.S.C. §119 to Japanese Patent Application No. 2007-093488, filed Mar. 30, 2007, the entire contents of which are hereby incorporated by reference.

BACKGROUND OF THE INVENTION

1. Field of the Invention

The present invention relates to an internal combustion engine including: a valve system including a camshaft for opening and closing an engine valve provided in a cylinder head; and a breather system provided with a breather chamber into which blow-by gas flows from a crank chamber having a crankshaft housed therein.

2. Description of Background Art

An internal combustion engine with the following configuration has been known (see, for example, International Patent Publication No. WO 2005/005793).

Specifically, this internal combustion engine includes a valve system, a breather system, and a decompression system. The valve system includes a camshaft for opening and closing an engine valve. The breathe system is provided with a breather chamber into which blow-by gas flows through an introduction space communicating with a crank chamber having a crankshaft housed therein. The decompression system releases a compression pressure in a combustion chamber. In this internal combustion engine, the rotation of a member which is provided to the camshaft, and which forms the breather chamber, is utilized so that oil separated in the breather chamber can be caused to flow out of the breather chamber by a centrifugal force.

Suppose a case where, in a breather system, oil separated in a breather chamber is caused to flow out of the breather chamber by utilizing centrifugal force generated by the rotation of the camshaft of the valve system. In this case, if a rotating member which forms the breather chamber, and which rotates integrally with the camshaft is attached to the camshaft, the formation of the breather chamber leads to an increase in the number of components.

In addition, when the breather chamber is formed of the rotating member, blow-by gas flows into the breather chamber in a direction from the radially outer side to the radially inner side of the rotating member positioned radially outward of the camshaft. Hence, it is difficult to allow the blow-by gas to smoothly flow into the breather chamber.

Moreover, the blow-by gas which has flown into the breather chamber swirls in association with the rotation of the rotating member. Accordingly, if the distance over which the blow-by gas flows in the breather chamber is increased to accelerate the gas-liquid separation utilizing a centrifugal force (that is, separation of oil) in the axial direction of the camshaft, the size of the rotating member is increased in the axial direction. Hence, an engine body part (for example, a cylinder head) in which the camshaft is provided is increased in size in the axial direction. In addition, when multiple breather chambers are provided outside the camshaft and along the axial direction of the camshaft in order to enhance the gas-liquid separation function in the breather chambers, the engine body part is further increased in size in the axial direction.

SUMMARY AND OBJECTS OF THE INVENTION

The present invention has been made in consideration of the above-described circumstances. The first to sixth aspects of the present invention aim to enhance, in the breather system where the gas-liquid separation is performed by utilizing the rotation of the camshaft, a gas-liquid separating function in a breather chamber, and to reduce the number of components of a breather system as well as the size of an internal combustion engine in the axial direction of a camshaft. In addition, the second aspect of the present invention aims to provide, with a simple structure, a baffle portion for separating oil in a hollow part that will be the breather chamber by forming the hollow part of multiple hole portions having different sizes. Moreover, the fourth and fifth aspects of the present invention aim to improve the gas-liquid separating function by utilizing a member allowing two breather chambers to communicate with each other. Furthermore, the sixth aspect of the present invention aims to improve the lubrication of a decompression shaft of a decompression system by utilizing oil separated in the breather chamber.

A first aspect of the present invention is an internal combustion engine including a cylinder head, a valve system, and a breather system. The cylinder head is provided with an engine valve. The valve system includes a camshaft provided with a valve cam for opening and closing the engine valve, while the camshaft is rotationally driven by power of a crankshaft housed in a crank chamber. The breather system is provided with a breather chamber into which blow-by gas flows through an introduction space communicating with the crank chamber. In addition, the camshaft is provided with a hollow part penetrating the camshaft in the axial direction of the camshaft. Moreover, the breather chamber is constituted of an upstream-side breather chamber formed of the hollow part, and a downstream-side breather chamber into which the blow-by gas flows from the upstream-side breather chamber. Furthermore, the hollow part opens to the introduction space at a first shaft end portion of the camshaft, and also opens to the downstream-side breather chamber at a second shaft end portion of the camshaft.

A second aspect of the present invention is the internal combustion engine further including a plurality of hole portions, a baffle portion with which the blow-by gas collides, and an oil recovery hole. The plurality of hole portions have different sizes, and are aligned in the axial direction to form the hollow part. The baffle portion is formed of a step wall between, among the plurality of hole portions, a large-sized hole portion on the upstream side and a small-sized hole portion adjacent to the large-sized hole portion on the downstream side. The oil recovery hole is provided in the camshaft in a manner of opening to the large-sized hole portion in a vicinity of the baffle portion so as to discharge oil in the breather chamber to the outside of the camshaft.

A third aspect of the present invention is the internal combustion engine further including a cam holder which is provided in the cylinder head to rotatably support the camshaft. In addition, the downstream-side breather chamber is formed by the cam holder.

A fourth aspect of the present invention is the internal combustion engine further including a cylindrical member. The cylindrical member is provided in the camshaft, and allows the upstream-side breather chamber and the downstream-side breather chamber to communicate with each other. In addition, the cylindrical member includes a bottom wall arranged in the upstream-side breather chamber. Moreover, the bottom wall forms a downstream-side baffle portion with which the blow-by gas collides.

A fifth aspect of the present invention is the internal combustion engine further having the following characteristics. Specifically, the camshaft includes an opening which allows the upstream-side breather chamber and the downstream-side breather chamber to communicate with each other, and which is provided at a position offset from the rotation center line of the camshaft. In addition, the cylindrical member is fitted into the opening.

A sixth aspect of the present invention is the internal combustion engine further including a decompression system. The decompression system includes a decompression shaft operating a decompression element for releasing a compression pressure in a combustion chamber by opening a decompression valve. In addition, the decompression shaft is rotatably housed in a housing hole opening to the downstream-side breather chamber at the second shaft end portion.

Effects of the invention include the following:

According to the first aspect of the present invention, since the upstream-side breather chamber is formed inside the camshaft, it is possible to reduce the number of components of the breather system, and concurrently to reduce the weight of the camshaft.

In addition, the upstream-side breather chamber formed of the hollow part extends, in the axial direction, inside the camshaft. Utilizing the shaft length of the camshaft makes it possible to increase the distance over which blow-by gas flows in the upstream-side breather chamber. Accordingly, the gas-liquid separating function by centrifugation can be improved. Concurrently, the gas-liquid separation is performed also in the downstream-side breather chamber communicating with the upstream-side breather chamber. As a result, it is possible to improve the gas-liquid separating function in the breather system where the gas-liquid separation is performed by utilizing the rotation of the camshaft.

Moreover, the upstream-side breather chamber is formed of the hollow part, which opens to the downstream-side breather chamber at the second shaft end portion of the camshaft. The second shaft end portion of the camshaft thus faces the downstream-side breather chamber. Accordingly, both of the upstream-side and downstream-side breather chamber can be disposed with a space only for providing the downstream-side breather chamber in the axial direction of the camshaft. As a result, it is possible to reduce the size, in the axial direction, of the engine body part provided with the camshaft, in comparison with a breather chamber requiring an enough space to dispose, in the axial direction, two breather chambers in addition to a camshaft.

Furthermore, the hollow part opens to the introduction space at the first shaft end portion of the camshaft. The upstream-side breather chamber thus opens to the introduction space at the first shaft end portion of the camshaft. Accordingly, upon rotation of the camshaft, blow-by gas in the introduction space flows into the upstream-side breather chamber more smoothly than a case where blow-by gas flows into a breather chamber from a position on the outer side in the radial direction, of the camshaft. As a result, the breather function of the breather system can be improved.

According to the second aspect of the present invention, the hollow part to be the breather chamber is formed of the plurality of hole portions having sizes different from one another. This makes it possible to form the baffle portion with the step wall between each two, adjacent to each other in the axial direction, of the hole portions. Accordingly the baffle portion for separating oil mixed in blow-by gas can be provided with a simple structure in the hollow part penetrating the camshaft. As a result, the gas-liquid separating function of the breather chamber can be improved.

According to the third aspect of the present invention, the downstream-side breather chamber is formed at the downstream of the upstream-side breather chamber provided in the camshaft. Accordingly, the gas-liquid separating function in the breather chamber can be improved. Moreover, since the downstream-side breather chamber is formed by utilizing the cam holder for supporting the camshaft, it is possible to form the downstream-side breather chamber without increasing the number of components.

According to the fourth aspect of the present invention, the baffle portion can be formed by utilizing the cylindrical member for guiding blow-by gas in the upstream-side breather chamber to the downstream-side breather chamber. This makes it possible to further improve the gas-liquid separating function in the upstream-side breather chamber provided in the camshaft. Moreover, since the need for a dedicated member to form the baffle portion is eliminated, this contributes to a reduction in the number of components.

According to the fifth aspect of the present invention, the cylindrical member is offset, in the radial direction, from the rotation center line of the camshaft, in the upstream-side breather chamber where the cylindrical member is disposed. Accordingly, it is possible to further accelerate the gas-liquid separation by utilizing a larger centrifugal force.

According to the sixth aspect of the present invention, since the housing hole in which the decompression shaft is housed opens to the downstream-side breather chamber, oil existing in the downstream-side breather chamber enters the housing hole. As a result, it is possible to improve the lubrication of the decompression shaft by utilizing oil separated from blow-by gas in the downstream-side breather chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
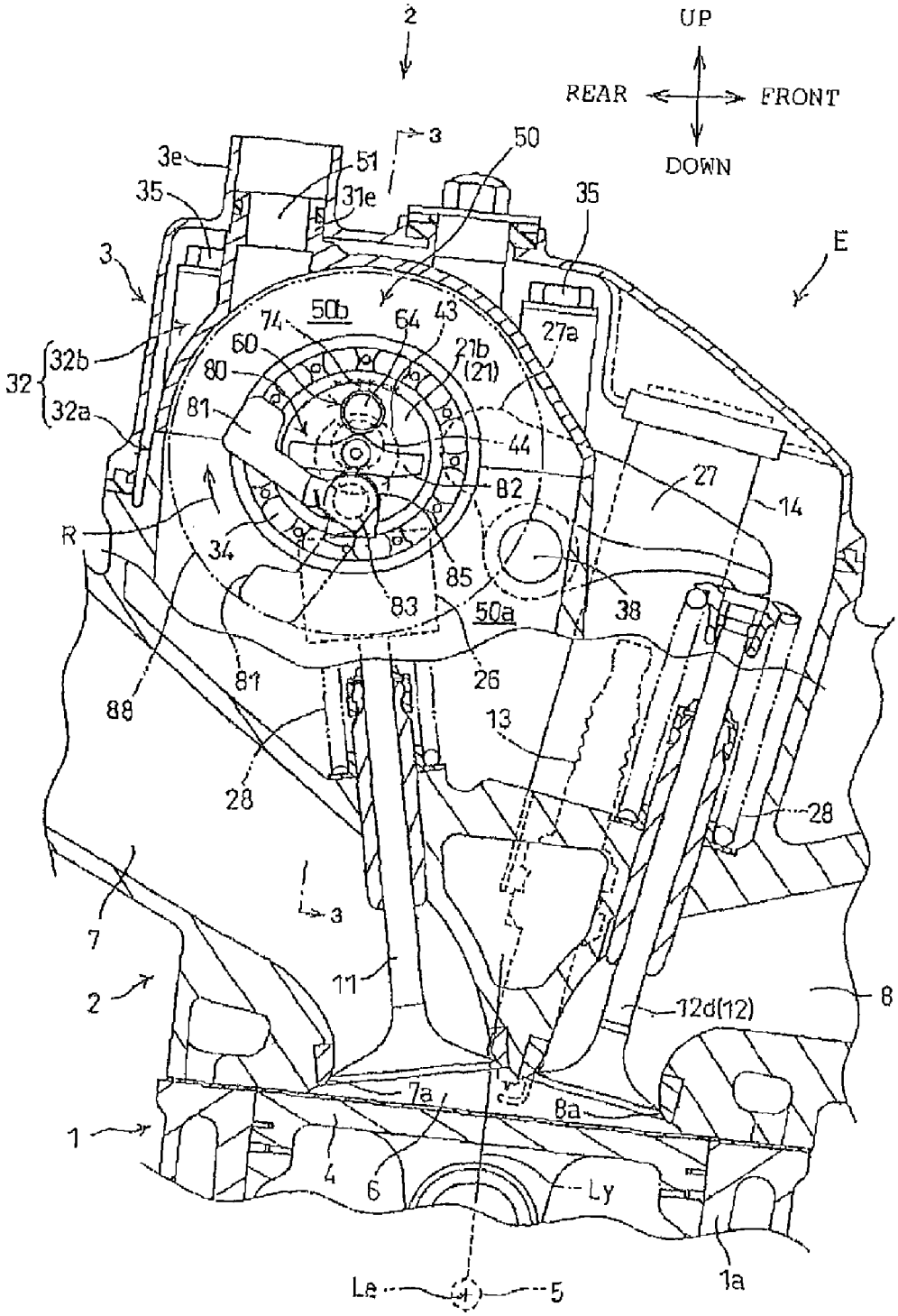
FIG. 1 is a cross-sectional view showing the chief part of an internal combustion engine to which the present invention is applied. A part of FIG. 1 is a schematic cross-sectional view taken along the line 1*a*-1*a* in FIG. 2, while the rest of FIG. 1 is a schematic cross-sectional view taken along the line 1*b*-1*b* in FIG. 2.

Refer to FIG. 1. An internal combustion engine E to which the present invention applied is mounted on a small vehicle, for example, a saddle-ride type four-wheeled vehicle and a motorcycle.

The internal combustion engine E is a water-cooled single-cylinder 4-stroke internal combustion engine, and includes an engine body constituted of a crankcase, a cylinder block 1, a cylinder head 2, and a head cover 3. The crankcase forms a crank chamber in which a crankshaft 5 is housed. The crankshaft 5 has a rotation center line Le oriented in the right-and-left direction, which coincides with the width direction of the vehicle. The cylinder block 1 has a single cylinder 1*a*, and is joined to an upper portion of the crankcase. The cylinder head 2 is joined to an upper portion of the cylinder block 1, and the head cover 3 is joined to an upper portion of the cylinder head 2. The crankcase, the cylinder block 1, the cylinder head 2, and the head cover 3 are engine body parts constituting the engine body.

In this embodiment, the front, the rear, the right, and the left respectively indicate the front, the rear, the light, and the left, of the vehicle, while the axial direction indicates the direction of a rotation center line of a camshaft 21, which will be described later. In addition, in this embodiment, the axial direction coincides with the right-and-left direction. When a first one of the left and right is a first side in the axial direction, a second one of the left and right is a second side in the axial direction. Moreover, the radial direction and the circumferential direction respectively indicate the radial direction and the circumferential direction at the time when the rotation center line Le (see FIG. 2) of the camshaft 21 is taken as the center.

A cylinder 1*a* has a cylinder axis Ly extending upward and also being slightly inclined frontward with respect to the vertical line. A piston 4 is reciprocatably fitted in the cylinder 1*a*, and joined to the crankshaft 5 with a connecting rod in between.

The cylinder head 2 is provided with a combustion chamber 6, an intake port 7, an exhaust port 8, a pair of intake valves 11 each serving as an engine valve, a pair of exhaust valves 12 also each serving as an engine valve, and a spark plug 13. The combustion chamber 6 faces the piston 4 in the direction of the cylinder axis Ly. The intake port 7 has a pair of intake openings 7*a* each opening to the combustion chamber 6. The exhaust port 8 has a pair of exhaust openings 8*a* each opening to the combustion chamber 6. Each of the intake valves 11 opens and closes a corresponding one of the intake openings 7*a*. Each of the exhaust valves 12 opens and closes a corresponding one of the exhaust openings 8*a*. The spark plug 13 faces the combustion chamber 6, and also is housed in a housing cylinder 14.

Figure 2:
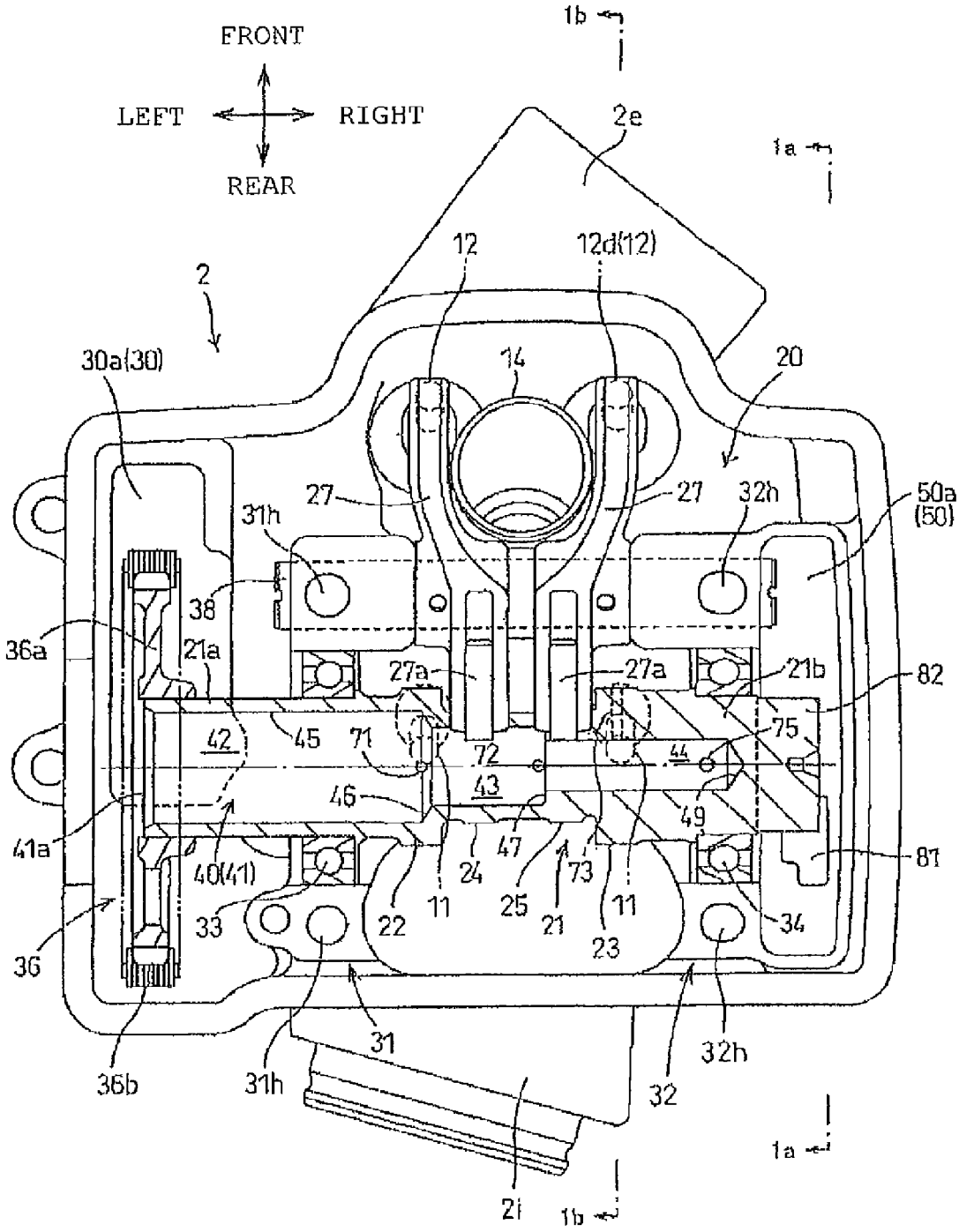
FIG. 2 is a view of the chief part of a cylinder head in the direction of the arrow 2 in FIG. 1, and shows a camshaft in a cross-section.
Figure 3:
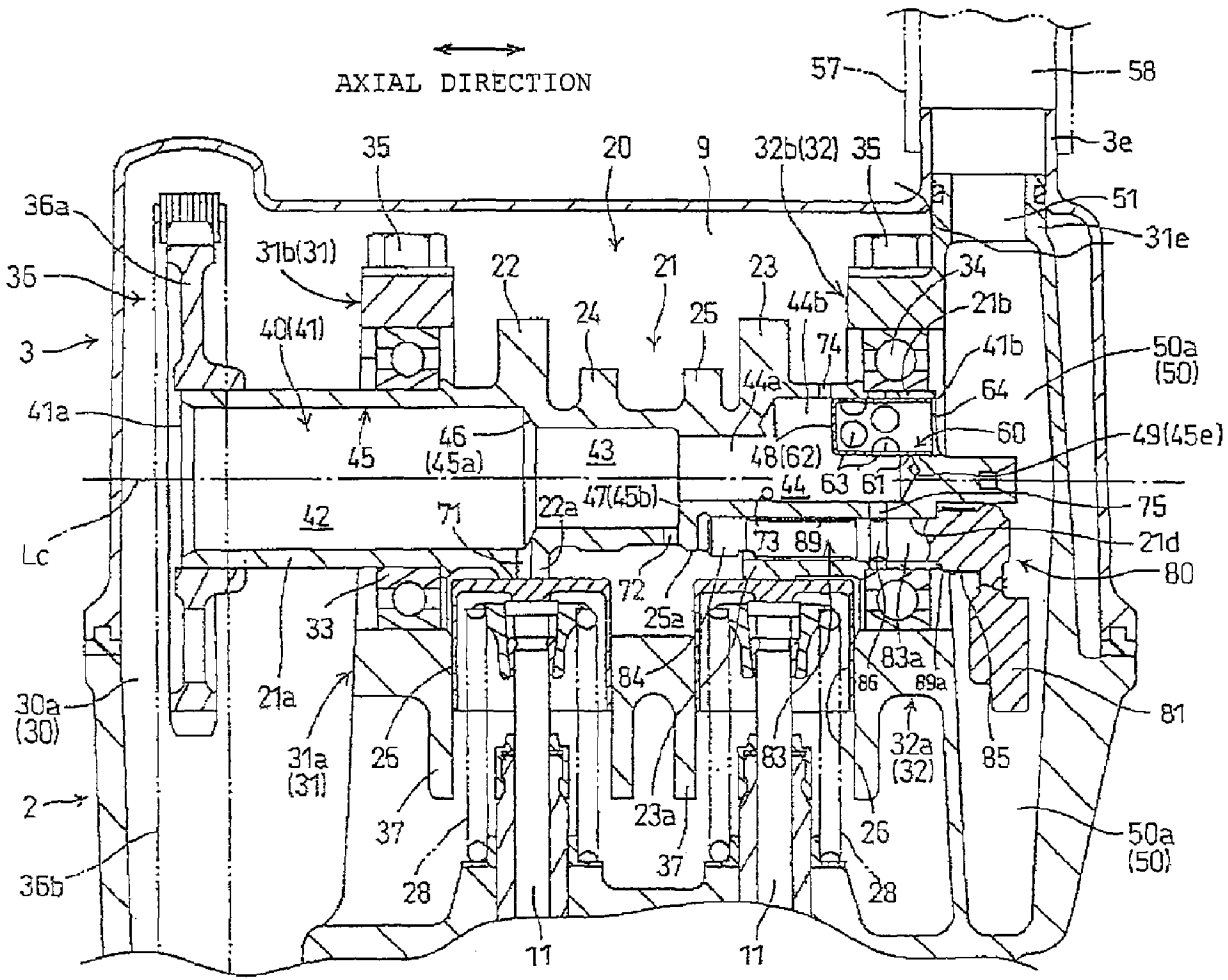
FIG. 3 is a schematic cross-sectional view taken along the line 3-3 in FIG. 1, and shows the chief part.

Refer to FIG. 1 to FIG. 3. The intake valves 11 and the exhaust valves 12 are driven by a valve system 20 included in the internal combustion engine E. Each of the intake valves 11 and the exhaust valves 12 opens and closes a corresponding one of the intake port 7 and the exhaust port 8 in synchronization with the rotation of the crankshaft 5.

The valve system 20 is disposed in a valve chamber 9 formed by the cylinder head 2 and the head cover 3. The valve system 20 includes a single camshaft 21, valve lifters 26 and rocker arms 27 each serving as a cam follower, and valve springs 28, for the single cylinder 1*a*. The camshaft 21 is rotationally driven by the crankshaft 5 so as to open and close the intake valves 11 and the exhaust valves 12. The camshaft 21 is provided with intake cams 22, 23 and exhaust cams 24, 25, each serving as a valve cam. Each of the valve lifters 26 and the rocker arms 27 is driven by a corresponding one of the intake cams 22, 23 and exhaust cams 24, 25. Each of the valve springs 28 constantly biases a corresponding one of the intake valves 11 and the exhaust valves 12 in a valve-closing direction.

The camshaft 21 is rotatably supported in the cylinder head 2 with a pair of bearings 33 and 34 in between. The bearings 33 and 34 are supported respectively by a pair of cam holders 31 and 32 provided in the cylinder head 2. The cam holder 31 is constituted of a lower holder 31*a* and an upper holder 31*b* while the cam holder 32 is constituted of a lower holder 32*a* and an upper holder 32*b*. The lower holders 31*a* and 32*a* are formed integrally in the cylinder head 2. The upper holders 31*b* and 32*b* are fastened respectively to the lower holders 31*a* and 32*a* with bolts 35 screwed into screw holes 31*h* and 32*h* (see FIG. 2) of the corresponding lower holders 31*a* and 32*a*. The camshaft 21 has a rotation center line Le which is parallel to the rotation center line Le of the crankshaft 5. The pair of intake cams 22 and 23 as well as the pair of exhaust cams 24 and 25 are provided to portions, disposed in the valve chamber 9, of the camshaft 21. The intake cams 22 and 23 drive the pair of valve lifters 26, respectively. The exhaust cams 24 and 25 are disposed between the intake cams 22 and 23 in the axial direction, and drive the pair of rocker arms 27, respectively.

The camshaft 21 provided in the cylinder head 2 is rotationally driven by driving power of the crankshaft 5. The driving power is transmitted from the crankshaft 5 to the camshaft 21 via a chain-drive power transmission system 36 serving as a power transmission system. The chain-drive transmission system 36 is housed in a chain chamber 30, which serves as a power transmission chamber, formed adjacent to the valve chamber 9 with the cam holder 31 sandwiched in between in the axial direction. The power transmission system 36 includes a chain 36*b* serving as an endless power transmission belt. The chain 36*b* is looped around a driven sprocket 36*a* serving as a driven rotor and a drive sprocket (not illustrated) serving as a drive rotor. The driven sprocket 36*a* is provided on a first shaft end portion 21*a* of the camshaft 21. Here, the first shaft end portion 21*a* projects leftward from the valve chamber 9 or the cam holder 31. The drive sprocket is provided on the crankshaft 5. The chain chamber 30, which is formed in and through the cylinder head 2, the cylinder block 1, and the crankcase, is constituted of an upper chain chamber 30*a* and a lower chain chamber (not illustrated). The upper chain chamber 30*a* is formed by the cylinder head 2 and the head cover 3, and communicates with the valve chamber 9. The lower chain chamber is formed by the cylinder block 1 and the crankcase, and communicates with the crank chamber.

Each of the cylindrical valve lifter 26 is slidably supported in a cylindrical supporting portion 37 molded integrally with the cylinder head 2. The valve lifters 26 are pressed respectively by the intake cams 22 and 23 to thus slide. On the other hand, the rocker arms 27 are swingably supported respectively by a rocker shaft 38 held by the cam holders 31 and 32. Each of the rocker arms 27 has a roller 27*a* serving as a cam abutting portion which is brought into contact with a corresponding one of the exhaust cams 24 and 25. The rollers 27*a* are pressed respectively by the exhaust cams 24 and 25 to swing. Accordingly, the intake cams 22 and 23 open and close the respective intake valves 11 with the corresponding valve lifters 26, while the exhaust cams 24 and 25 open and close the respective exhaust valves 12 with the corresponding rocker arms 27.

An intake air passes through an intake passage formed by an intake system (not illustrated) including an inlet pipe attached to a side portion 2*i*, where the inlet of the intake port 7 opens, of the cylinder head 2. The intake air is then mixed with a fuel to form an air-fuel mixture, while the fuel is supplied from an air-fuel mixture forming system constituted of a fuel injection valve. The air-fuel mixture passes through the intake port 7 to be sucked into the combustion chamber 6 when the intake valves 11 are opened in the intake stroke. The air-fuel mixture is compressed in the compression stroke where the piston 4 ascends, and is then ignited by the spark plug 13 to be combusted in the end phase of the compression stroke. The piston 4 is thus driven by the pressure of the combustion gas to rotationally drive the crankshaft 5 in the expansion stroke where the piston 4 descends. The combustion gas is discharged as an exhaust gas from the combustion chamber 6 to pass through the exhaust port 8 when the exhaust valves 12 are opened in the exhaust stroke where the piston 4 ascends. Thereafter, the exhaust gas is discharged to the outside of the internal combustion engine E after passing through an exhaust passage formed by an exhaust system (not illustrated) including an exhaust pipe attached to a side portion 2*e*, where the outlet of the exhaust port 8 opens, of the cylinder head 2.

The internal combustion engine E includes a breather system which guides, to the intake passage, blow-by gas existing in the crank chamber, which is a space where the blow-by gas remains within the engine body (hereinafter, simply referred to as a "breather system"). The breather system is provided with breather chambers 40 and 50, a breather passage, and an oil recovery passage. Each of the breather chambers 40 and 50 has a gas-liquid separating function of separating oil mixed in blow-by gas. The breather passage includes the chain chamber 30 and a lead-out passage 58. The chain chamber 30 communicates with the crank chamber, and serves as an introducing space for introducing the blow-by gas in the crank chamber to the breather chamber 40. The lead-out passage 58 guides, from the breather chamber 50 to the intake passage, the blow-by gas from which the oil has been separated in the breather chamber 40. The oil recovery passage discharges the oil which has been separated in the breather chambers 40 and 50 to the outside of the breather chambers 40 and 50.

The lead-out passage 58 is formed of a conduit pipe 57 which is connected, at the upstream end thereof, to a connecting portion 3*e* provided to the head cover 3, and which also is connected, at the downstream end thereof, to the intake system. Accordingly, the crank case, the cylinder block 1, the cylinder head 2, the head cover 3, and the conduit pipe 57 are breather passage forming members which form the breather passage including the introduction space (the chain chamber 30) and the lead-out passage 58.

The breather chambers 40 and 50 are constituted of the upstream-side breather chamber 40 and the downstream-side breather chamber 50. The upstream-side breather chamber 40 is provided in the camshaft 21. The blow-by gas flows into the upstream-side breather chamber 40 from the crank chamber via the chain chamber 30. The downstream-side breather chamber 50 is formed by the cam holder 32. The blow-by gas 40 flows into the downstream-side breather chamber 50 from the upstream-side breather chamber 40. Accordingly, the camshaft 21 and the cam holder 32 are breather chamber forming members which form the breather chambers 40 and 50.

Here, the upstream and downstream are of the flow of the blow-by gas in the breather system.

The breather chamber 40 is constituted of a through hole 41 serving as a hollow part provided inside the camshaft 21, and which linearly extends in the axial direction of the camshaft 21. The through hole 41 penetrating the camshaft 21 along the axial direction has openings 41*a* and 41*b*. The opening 41*a* opens, at the first shaft end portion 21*a* of the camshaft 21, to the upper chain chamber 30*a* in the axial direction. On the other hand, the opening 41*b* opens, at a second shaft end portion 21*b* of the camshaft 21, to the breather chamber 50 in the axial direction. The through hole 41, that is, the breather chamber 40 is constituted of multiple hole portions 42, 43, and 44 arranged sequentially in the axial direction. The plurality of hole portions 42 to 44 have sizes different from one another in conjunction with the respective positions in the axial direction. The opening 41*a* constitutes the inlet of the breather chamber 40.

Here, the diameter of the through hole 41 (that is, the breather chamber 40), or of each of the hole portions 42 to 44, corresponds to the flow passage area of the through hole 41, or of the corresponding one of the hole portions 42 to 44.

These hole portions 42 to 43 are constituted of a most-upstream hole portion 42, a most-downstream hole portion 43, and at least one (one in this embodiment) intermediate hole portion 43 disposed between the most-upstream hole portion 42 and the most-downstream hole portion 44 in the axial direction (or, the direction of flow of blow-by gas in the breather chamber 40). The most-upstream hole portion 42 has the opening 41*a*, and communicates with the upper chain chamber 30*a*. The most-downstream hole portion 44 has the opening 41*b*, and communicates with the breather chamber 50 via a member 60 to be described later. The most-upstream hole portion 42 is formed of a circular hole having the largest size in the through hole 41, and having a center axis coincident with the rotation center line Le. The intermediate hole portion 43 is formed of a circular hole having a center axis coincident with the rotation center line Le. The most-upstream hole portion 42 has a diameter larger than the diameter of the intermediate hole portion 43. The most-downstream hole portion 44 has the smallest size in the through hole 41, and includes an upstream part 44*a* and a downstream part 44*b*. The upstream part 44*a*, positioned closer to the intermediate hole portion 43 in the axial direction, is formed of a circular hole having a diameter smaller than the diameter of the intermediate hole portion 43, and having the center axis offset from the rotation center line Lc. The downstream part 44*b* has a diameter larger than the upstream part 44*a*, and is an enlarged portion in which the member 60 is disposed. The opening 41*b* allows the most-downstream hole portion 44 and the breather chamber 50 to communicate with each other, thus allowing the breather chamber 40 and the breather chamber 50 to communicate with each other.

One or more baffle portions 46 and 47, are provided in the wall surface 45 of the through hole 41 (that is, the breather chamber 40). Each of the baffle portions 46 and 47 extends toward the rotation center line Lc as the axis of the through hole 41, that is, inward in the radial direction. The blow-by gas mixed with the oil collides with the baffle portions 46 and 47. The baffle portion 46 on the upstream side is constituted of an annular step wall 45*a* between the most-upstream hole portion 42 and the intermediate hole portion 43 which are adjacent to each other in the axial direction. On the other hand, the baffle portion 47 on the downstream side is constituted of an annular step wall 45*b* between the intermediate hole portion 43 and the upstream part 44*a* of the most-downstream hole portion 44 which are adjacent to each other in the axial direction.

Accordingly, the most-upstream hole portion 42 and the intermediate hole portion 43 are a pair of hole portions adjacent to each other in the axial direction. In this pair, the most-upstream hole portion 42 is a large-sized hole portion on the upstream side, while the intermediate portion 43 is a small-sized hole portion on the downstream side, which is adjacent to the large-sized hole portion in the axial direction. On the other hand, the intermediate hole portion 43 and the most-downstream hole portion 44 are another pair of hole portions adjacent to each other in the axial direction. In this pair, the intermediate hole portion 43 is a large-sized hole portion on the upstream side, while the most-downstream hole portion 44 is a small-sized hole portion on the downstream side, which is adjacent to the large-sized hole portion in the axial direction.

An oil recovery hole 71 is provided to the camshaft 21 in a vicinity of the baffle portion 46. The oil recovery hole 71 opens at a downstream end portion of the most-upstream hole portion 42. The oil separated from the blow-by gas colliding with the baffle portion 46 is allowed to flow from the most-upstream hole portion 42 into the oil recovery hole 71 to thus be discharged out of the camshaft 21. In the same manner, an oil recovery hole 72 is provided to the camshaft 21 in a vicinity of the baffle portion 47. The oil recovery hole 72 opens at a downstream end portion of the intermediate hole portion 43. The oil separated from the blow-by gas colliding with the baffle portion 47 is allowed to flow from the intermediate hole portion 43 into the oil recovery hole 72 to thus be discharged out of the camshaft 21. Here, the oil attached to each of the baffle portions 46 and 47 is blown out from a corresponding one of the oil recovery holes 71 and 72 to the inside of the valve chamber 9 by a centrifugal force generated by the rotation of the camshaft 21.

Moreover, the center axis of the upstream part 44*a* is offset, in the radial direction, from the center axis of the intermediate hole portion 43 (see FIG. 1 and FIG. 3). The oil recovery hole 72 is provided in a vicinity of a portion with a larger level difference, on the side opposite to the offset direction, in the step wall 45*b*.

The oil recovery hole 71 opens at the cam surface of a circular base portion 22*a* of the intake cam 22. The oil discharged through the oil recovery hole 71 is partly supplied to lubricate the contact portion between the intake cam 22 and the valve lifter 26, and also is partly blown out inside the valve chamber 9 to lubricate the valve system 20, such as the valve lifter 26 and the rocker arm 27. On the other hand, the oil discharged from the oil recovery hole 72 is blown out inside the valve chamber 9 to lubricate the valve system 20.

Here, each of the oil recovery holes 71 and 72 may open partly in the corresponding one of the step walls 45*a* and 45*b*.

In the camshaft 21, a cylindrical member having a bottom, that is, a cylindrical member 60 in this embodiment, is provided in the downstream part 44*b* of the most-downstream hole portion 44. The member 60 is separated from the camshaft 21, and functions also as a communication pipe allowing the breather chambers 40 and 50 to communicate with each other. The member 60 is attached in the following manner. Specifically, the member 60 is inserted into the downstream part 44*b* of the most-downstream hole portion 44 through the opening 41*b* provided at the position (see FIG. 1 and FIG. 3) offset, in the radial direction, from the center axis of the upstream part 44*a* as well as from the rotation center line Lc. The member 60 is then press fitted into the camshaft 21. While the member 60 is fitted into the opening 41*b* to be disposed in the most-downstream hole portion 44 in the breather chamber 40, the axis of the member 60 is offset, in the radial direction, from the rotation center line Lc. In this embodiment, the member 60 is disposed, to be entirely displaced outward in the radial direction from the rotation center line Lc, and concurrently to be in contact with the wall surface 45 of the most-downstream hole portion 44. In this manner, the member 60 is disposed at a position offset from the center axis of the upstream part 44*a*, which is offset from the rotation center line Lc, in the same radial direction as that in which the center axis of the upstream part 44*a* is offset from the rotation center line Lc (see FIG. 1 and FIG. 3).

The member 60 has a peripheral wall 61 and a bottom wall 62. Multiple circular inflow ports 63, each communicating with the most-downstream hole portion 44, are provided in the peripheral wall 61. The bottom wall 62 is provided at the upstream end portion of the peripheral wall 61. An outflow port 64 is formed at the downstream end portion of the peripheral wall 61, and opens to the breather chamber 50, thus being an outlet of the breather chamber 40. The imperforate bottom wall 62 with no hole provided therein constitutes a downstream-side baffle portion 48 with which the blow-by gas collides. Then, the blow-by gas in the most-downstream hole portion 44 flows into a communication passage formed by the member 60 through the inflow ports 63, and thereafter flows out into the breather chamber 50 through the outflow port 64.

An oil recovery hole 74 is provided to the camshaft 21 in a vicinity of, and on the upstream side of, the bottom wall 62 (the baffle portion 48). The oil recovery hole 74 opens to the downstream part 44*b* of the most downstream hole portion 44, and discharges, to the outside of the camshaft 21, the oil separated from the blow-by gas colliding with the bottom wall 62. The oil attached to the bottom wall 62 is blown out from the oil recovery hole 74 to the inside of the valve chamber 9 by the centrifugal force to lubricate the valve system 20.

Moreover, the camshaft 21 is provided with oil recovery holes 73 and 75. The oil recovery hole 73 opens to the most-downstream hole portion 44, and also opens at the cam surface of a circular base portion 23*a* of the intake cam 23. The oil recovery hole 75 opens to a housing hole 89 to be described later. The oil discharged from the oil recovery hole 73 by the centrifugal force is partly supplied to lubricate the contact portion between the intake cam 23 and The valve lifter 26, and also is partly blow out inside the valve chamber 9 to lubricate the valve system 20. A baffle portion 49 is formed by a bottom wall surface 45*e*, that is, the deepest part of the wall surface 45 of the through hole 41. The oil recovery hole 75 is an occluded hole formed of a through hole which penetrates in the radial direction in a vicinity of the baffle portion 49, but which is occluded by the bearing 34 on the outer side in the radial direction. Accordingly, since the oil flowing out from the oil recovery hole 75 and being pressurized by the centrifugal force is guided to the housing hole 89, the lubrication of a decompression shaft 83 is improved.

In this manner, each of the hole portions 42 to 44 is provided with at least one baffle portion (the baffle portions 46 to 48).

In addition, each of the oil recovery holes 71 to 75 is provided perpendicular to the rotation center line Lc, and allows the through hole 41 and the outside of the camshaft 21 to communicate with each other.

The oil recovery holes 71 to 75 constitute the oil recovery passage along with an oil recovery hole (not illustrated) provided to the lower holder 32*a* and allowing the oil separated in the breather chamber 50 to flow out into the valve chamber 9. The oil recovery passage blows out the oil separated by the gas-liquid separating function of the breather chambers 40 and 50 to the outside of the breather chambers 40 and 50 by utilizing the centrifugal force. Moreover, the position, in the circumferential direction of the camshaft 21, of each of the oil recovery holes 71 to 75 is selected as appropriate. For example, all the oil recovery holes 71 to 75 may be formed at different positions from one another in the circumferential direction.

The breather chamber 50 on the downstream side also functions as a housing chamber in which constituent components, such as a decompression weight 81, of a decompression system 80 to be described later are housed. The breather chamber 50 is a volume-enlarged chamber having a larger volume than that of the most-downstream hole portion 44, and is constituted of a lower chamber 50*a* and an upper chamber 50*b*. The lower chamber 50*a* is formed by the lower holder 32*a*, while the upper chamber 50*b* is formed by the upper holder 23*b*. The outlet 51 of the breather chamber 50 is formed by a pipe-shaped outlet portion 31*e* inserted into, and connected with, the connecting portion 3*e*. The outlet 51 opens in a direction which is a tangential direction of the maximum rotational trajectory (see FIG. 1) of the decompression weight 81 at a decompression release position to be described later, and which also is a rotational direction R of the camshaft 21. Accordingly, the blow-by gas in the breather chamber 50 is efficiently discharged to the outlet 51 by the rotating decompression weight 81, so that the flow out of the blow-by gas to the lead-out passage 58 is accelerated.

Now refer to FIG. 1 and FIG. 3. The internal combustion engine E includes the decompression system 80, which reduces the starting operation force by releasing the compression pressure in the combustion chamber 6 in the compression stroke at the time of starting the internal combustion engine E. The decompression system 80 is provided to the camshaft 21, and includes the decompression weight 81, a stopper 82, a decompression shaft 83, a decompression cam 84 and a control spring 85. The decompression weight 81 is movably supported by the camshaft 21, and moves in accordance with the engine rotation speed. The stopper 82 (see FIG. 2 as well) is molded integrally with the shaft end portion 21*b*, and sets the position of the decompression weight 81. The decompression shaft 83 is driven by the decompression weight 81, and concurrently supported by the camshaft 21. The decompression cam 84 serves as a decompression element operated by the decompression shaft 83. The control spring 85 controls the motion of the decompression cam 84 which occupies a decompression position or the decompression release position in accordance with the engine rotation speed. The control spring 85 sets, with its spring force, the operating range in which the decompression operation is performed by the decompression cam 84. The decompression weight 81, the stopper 82, and the control spring 85 are housed in the breather chamber 50.

Here, the decompression position is a position where the decompression cam 84 performs an operation of opening the exhaust valve 12 by pressing the valves 12 in the compression stroke, that is, a position where the decompression cam 84 performs the decompression operation in order to reduce the compression pressure in the combustion chamber 6. On the other hand, the decompression release position is a position where the decompression cam 84 does not open one of the exhaust valves 12*d* that serves as a decompression valve, that is, a position where the decompression cam 84 does not perform the decompression operation.

The decompression weight 81 is swingably supported by the camshaft 21, and can swing against the spring force of the control spring 85 by the action of the centrifugal force generated in accordance with the engine rotation speed. Specifically, when the engine rotation speed is not more than a set rotation speed, the decompression weight 81 abuts on the stopper 82, thus occupying the decompression position. On the other hand, when the engine rotation speed exceeds the set rotation speed, the decompression weight 81 swings to abut on the stopper 82, occupying the decompression release position (which is indicated by the alternate long and two short dashes line in FIG. 1). Here, the set rotation speed (hereinafter, simply referred to as the "set rotation speed") is an engine rotation speed at the time of the cranking of the internal combustion engine E.

The decompression shaft 83 is molded integrally with the decompression weight 81, and rotates integrally with the decompression weight 81. The decompression shaft 83 is housed slidably and rotatably in the housing hole 89 serving as a housing portion constituted of a circular hole extending parallel to the axial direction of the camshaft 21 from the shaft end portion 21*b* side. The decompression shaft 83 thus has a rotation center line which is offset from the rotation center line Lc by a predetermined distance, and which is parallel to the rotation center line Lc. The decompression shaft 83 is slidably supported, at a supported portion 83*a* thereof, that is, a large-diameter portion thereof, by a supporting portion 21*d* provided to the camshaft 21 to form the wall of the housing hole 89.

The housing hole 89 communicates with the breather chamber 40 via the oil recovery hole 75 opening to the supporting portion 21*d* positioned closer to the decompression weight 81 side. Concurrently, the housing hole 89 opens, at an opening 89*a* thereof, to the breather chamber 40 at the shaft end portion 21*b*, so as to communicate with the breather chamber 50.

An annular oil groove 86 is provided in the outer peripheral surface of the supported portion 83*a*, to face the oil recovery hole 75 in the radial direction. The oil separated in the breather chamber 40 flows through the oil recovery hole 75 and the housing hole 89, and then flows into the oil groove 86 to lubricate the supporting portion 21*d* and the supported portion 83*a* of the decompression shaft 83. Moreover, part of the oil in the breather chamber 50 enters the housing hole 89 through the opening 89*a* to lubricate the supporting portion 21*d* and the supported portion 83*a* of the decompression shaft 83.

The decompression cam 84 is molded integrally with the distal portion of the decompression shaft 83, which is joined, at the proximal portion thereof, to the decompression weight 81. The decompression cam 84 is slidably and rotatably supported by the cam shaft 21. When the engine rotation speed is not more than the set rotation speed, the decompression cam 84 occupies the decompression position where the decompression cam 84 slightly project more outward in the radial direction than the cam surface of the circular base portion 25*a* of the exhaust cam 25. Accordingly, the decompression cam 84 comes into contact with the roller 27*a* to perform the decompression operation, thus pressing and opening the exhaust valve 12*d* with the rocker arm 27. On the other hand, when the engine rotation speed exceeds the set rotation speed, the decompression cam 84 occupies, in accordance with the swing of the decompression weight 81, the decompression release position where the decompression cam 84 moves back more inward in the radial direction than the circular base portion 25*a*. Accordingly, the decompression cam 84 does not come into contact with the rocker arm 27, and thus does not open the exhaust valve 12*d*.

Next, descriptions will be given of the operations and effects of the embodiment configured as described above.

The breather system includes the breather chambers 40 and 50. The breather chamber 40 is constituted of the through hole 41, which is the hollow portion. The blow-by gas from the breather chamber 40 flows into the breather chamber 50. The through hole 41 opens to the upper chain chamber 30*a* of the chain chamber 30, at the first shaft end portion 21*a* of the camshaft 21, and also opens to the breather chamber 50, at the second shaft end portion 21*b* of the camshaft 21. Accordingly, since the breather chamber 40 is formed in the camshaft 21, it is possible to reduce the number of components for the breather system, and to thus reduce the weight of the camshaft 21.

In addition, the breather chamber 40 constituted of the through hole 41 extends in the axial direction in the camshaft 21. Accordingly, it is possible to extend, by utilizing the axial length of the camshaft 21, the distance over which the blow-by gas flows into the breather chamber 40. As a result, the gas-liquid separating function by the centrifugal force can be improved. Moreover, the gas-liquid separation is performed also in the breather chamber 50 communicating with the breather chamber 40. Accordingly, it is possible to further improve the gas-liquid separating function in the breather system, where the gas-liquid separation is performed by utilizing the rotation of the camshaft 21.

Furthermore, the breather chamber 40 is constituted of the through hole 41. Since, the through hole 41 opens to the breather chamber 50 at the second shaft end portion 21*b* of the camshaft 21, the shaft end portion 21*b* faces the breather chamber 50. Accordingly, the breather chamber 40 and the breather chamber 50 can be disposed with only a space for the breather chamber 50 in the axial direction of the camshaft 21. As a result, it is possible to reduce, in the axial direction, the size of the cylinder head serving as the engine body portion provided with the camshaft 21, in comparison with a breather system which requires a space, in the axial direction, for disposing two breather chambers in addition to the camshaft 21.

In addition, the opening 41*a* of the through hole 40 opens, at the first shaft end portion 21*a*, in the axial direction, to the upper chain chamber 30*a* of the chain chamber 30. In other words, the breather chamber 40 opens to the upper chain chamber 30*a* at the first shaft end portion 21*a*. Accordingly, when the camshaft 21 rotates, the blow-by gas in the upper chain chamber 30*a* smoothly flows into the breather chamber 40 in comparison with a case where the blow-by gas flows into the breather chamber from a position on the outer side in the radial direction than the camshaft 21. As a result, it is possible to improve the breather function of the breather system.

The through hole 41 is constituted of the plurality of hole portions 42, 43, and 44 having different sizes from one another. Each of the baffle portions 46 and 47, with which blow-by gas collides, is formed of the step wall 45*a* (45*b*) between a large-sized hole portion, that is, the hole portion 42 (43) on the upstream side and a small-sized hole portion, that is, the hole portion 43 (44), adjacent to the hole portion 42 (43) in the axial direction, on the downstream side, among the hole portions 42 to 44. The camshaft 21 is provided with the oil recovery holes 71 and 72. Each of the oil recovery holes 71 and 72 opens in the vicinity of the corresponding one of the baffle portions 46 and 47 to the most-upstream hole portion 42 or the intermediate hole portion 43. The oil recovery holes 71 and 72 thus discharge the oil in the breather chamber 40 to the outside of the camshaft 21. Accordingly, the baffle portions 46 and 47 can be constituted respectively of the step wall 45*a* between the hole portions 42 and 43, adjacent to each other in the axial direction; and the step wall 45*b* between the hole portions 43 and 44, adjacent to each other in the axial direction. This makes it possible to provide the baffle portions 46 and 47, for separating the oil mixed with the blow-by gas, with a simple structure in the through hole 41 penetrating the camshaft 21. As a result, the gas-liquid separating function of the breather chamber 40 can be improved.

In addition, since the diameter of each of the plurality of hole portions 42 to 44 is reduced in order from the upstream side to the downstream side, it is possible to smoothly discharge the blow-by gas without stagnating in the breather chamber 40.

The cam holders 31 and 32 for rotatably supporting the camshaft 21 are provided to the cylinder head 2. The breather chamber 50 into which the blow-by gas flows from the breather chamber 40 is provided to the cam holder 32. Since the breather chamber 50 is separately formed at the downstream of the breather chamber 40 provided in the camshaft 21, it is possible to improve the gas-liquid separating function in the breather system. Moreover, since the breather chamber 50 is formed by utilizing the cam holder 32 for supporting the camshaft 21, it is possible to form the breather chamber 50 without increasing the number of components.

The camshaft 21 is provided with the cylindrical member 60 which allows the breather chamber 40 to communicate with the breather chamber 50 on the downstream side of the breather chamber 40. The cylindrical member 60 has the bottom wall 62 arranged in the breather chamber 40. The bottom wall 62 constitutes the baffle portion 48 with which the blow-by gas collides. The baffle portion 48 can thus be formed by utilizing the cylindrical member 60 functioning also as the communication pipe for guiding the blow-by gas in the breather chamber 40 to the breather chamber 50. This makes it possible to further improve the gas-liquid separating function in the breather chamber 40 provided in the camshaft 21. In addition, since there is no need for a member dedicated to form the baffle portion 48, this contributes to a reduction in the number of components.

In addition, the camshaft 21 is provided with the opening 41*b* at the position which is offset from the rotation center line Lc. The opening 41*b* allows the most-downstream hole portion 44, among the plurality of hole portions 42 to 44, to communicate with the breather chamber 50. The member 60 is fitted into the opening 41*b* to be disposed in the most-downstream hole portion 44. Since the member 60 is offset, in the radial direction, from the rotation center line Lc in the most-downstream hole portion 44 in which the member 60 is disposed, it is possible to further accelerate the gas-liquid separation by utilizing a large centrifugal force.

The center axis of the upstream part 44*a* of the most-downstream hole portion 44 is offset from the rotation center line Lc. The member 60 is further offset from the center axis of the upstream part 44*a* in the same radial direction as that in which that center axis is offset from the rotation center line Lc. Accordingly, since the amount of offset of the member 60 is further increased, the gas-liquid separation can be further accelerated.

The decompression system 80 is provided in the camshaft 21, and includes the decompression shaft 83 for operating the decompression cam 84, which releases the compression pressure in the combustion chamber 6 by opening the exhaust valve 12 in the compression stroke. Since the housing hole 89, in which the decompression cam 83 is housed, opens to the breather chamber 50, the oil existing in the breather chamber 50 enters the housing hole 89. As a result, it is possible to improve the lubrication of the decompression shaft 83 by utilizing the oil separated from the blow-by gas in the breather chamber 50.

In addition, the decompression shaft 83 is slidably housed in the housing hole 89 which is provided in the camshaft 21, and into which the oil from the breather chamber 40 flows. Accordingly, the oil separated in the breather chamber 40 provided in the camshaft 21 is supplied through the oil recovery hole 75 to the decompression shaft 83 provided also in the camshaft 21. As a result, it is possible to improve the lubrication of the decompression shaft 83 by utilizing the oil recovered from the breather chamber 40 with a simple structure in which the oil recovery hole 75 is provided.

Hereinafter, modified embodiments in each of which part of the configuration of the above-described embodiment is modified will be described with the focus on the modified configurations.

Suppose a case, for example, where the diameter of the through hole provided in the camshaft 21 is constant in the axial direction. In this case, the baffle portions may be members which are separated from the camshaft 21, and which are attached to the camshaft 21 to protrude in the through hole from the wall surface of the through hole.

Suppose a case where multiple intermediate hole portions are provided. In this case, the intermediate hole portions are preferably aligned so that the diameters of the intermediate hole portions are sequentially reduced along the flow of the blow-by gas. With this configuration, since the number of baffle portions each formed by a step wall between corresponding two, adjacent to each other in the axial direction, of the hole portions is increased, the gas-liquid separating function is improved. However, the alignment of the series of hole portions may be configured partially in a manner where a first hole portion, on the downstream side, may have a larger size than that of a second hole portion, next to the first hole portion, on the upstream side.

The introduction space may be, instead of the chain chamber 30, a space or a passage, which communicates with the crank chamber.

The entirety of the cam holders may be formed of a member separated from the cylinder head so as to be attached to the cylinder head with joint means such as a bolt.

The camshaft may be provided to the crankcase or the cylinder block, and each of the intake valves and the exhaust valves may be opened and closed by a transmission bar such as a push rod.

The internal combustion engine may be a multicylinder internal combustion engine having multiple cylinders.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine comprising:

a cylinder head provided with an engine valve;

a valve system including a camshaft provided with a valve cam for opening and closing the engine valve, the camshaft being rotationally driven by power of a crankshaft housed in a crank chamber; and a breather system provided with a breather chamber into which blow-by gas flows through an introduction space communicating with the crank chamber, wherein the camshaft is provided with a hollow part penetrating the camshaft in an axial direction of the camshaft, the breather chamber is constituted of an upstream-side breather chamber formed of the hollow part, and a downstream-side breather chamber into which the blow-by gas flows from the upstream-side breather chamber, and the hollow part opens to the introduction space at a first shaft end portion of the camshaft, and also opens to the downstream-side breather chamber at a second shaft end portion of the camshaft, wherein the downstream-side breather chamber has a volume-enlarged chamber surrounding and extending in the axial direction beyond the second shaft end portion of the camshaft.

2. The internal combustion engine according to claim 1, further comprising:

a plurality of hole portions having different sizes including a large-sized hole portion and a small-sized hole portion, the plurality of hole portions being aligned in the axial direction to form the hollow part;

a baffle portion with which the blow-by gas collides, and which is formed of a step wall between, among the plurality of hole portions, the large-sized hole portion on an upstream side and the small-sized hole portion adjacent to the large-sized hole portion on a downstream side; and an oil recovery hole provided in the camshaft, and opening to the large-sized hole portion in a vicinity of the baffle portion so as to discharge oil in the breather chamber to an outside of the camshaft.

3. The internal combustion engine according to claim 1, further comprising a cam holder which is provided in the cylinder head to rotatably support the camshaft, wherein the downstream-side breather chamber is formed by the cam holder.

4. The internal combustion engine according to claim 2, further comprising a cam holder which is provided in the cylinder head to rotatably support the camshaft, wherein the downstream-side breather chamber is formed by the cam holder.

5. The internal combustion engine according to claim 1, further comprising a cylindrical member which is provided in the camshaft, and which allows the upstream-side breather chamber and the downstream-side breather chamber to communicate with each other, wherein the cylindrical member includes a bottom wall arranged in the upstream-side breather chamber, and the bottom wall forms a downstream-side baffle portion with which the blow-by gas collides.

6. The internal combustion engine according to claim 2, further comprising a cylindrical member which is provided in the camshaft, and which allows the upstream-side breather chamber and the downstream-side breather chamber to communicate with each other, wherein the cylindrical member includes a bottom wall arranged in the upstream-side breather chamber, and the bottom wall forms a downstream-side baffle portion with which the blow-by gas collides.

7. The internal combustion engine according to claim 5, wherein the camshaft includes an opening which allows the upstream-side breather chamber and the downstream-side breather chamber to communicate with each other, and which is provided at a position offset from the rotation center line of the camshaft, and the cylindrical member is fitted into the opening.

8. The internal combustion engine according to claim 6, wherein the camshaft includes an opening which allows the upstream-side breather chamber and the downstream-side breather chamber to communicate with each other, and which is provided at a position offset from the rotation center line of the camshaft, and the cylindrical member is fitted into the opening.

9. The internal combustion engine according to claim 1, further comprising a decompression system including a decompression shaft operating a decompression element for releasing a compression pressure in a combustion chamber by opening a decompression valve, wherein the decompression shaft is rotatably housed in a housing hole opening to the downstream-side breather chamber at the second shaft end portion.

10. The internal combustion engine according to claim 2, further comprising a decompression system including a decompression shaft operating a decompression element for releasing a compression pressure in a combustion chamber by opening a decompression valve, wherein the decompression shaft is rotatably housed in a housing hole opening to the downstream-side breather chamber at the second shaft end portion.

11. An internal combustion engine comprising:

a cylinder head provided with an engine valve;

a valve system including a camshaft provided with a valve cam for opening and closing the engine valve, the camshaft being rotationally driven by power of a crankshaft housed in a crank chamber; and a breather system provided with a breather chamber into which blow-by gas flows through a chain chamber communicating with the crank chamber, wherein the camshaft is provided with a hollow part penetrating the camshaft in an axial direction of the camshaft, the breather chamber is constituted of an upstream-side breather chamber formed of the hollow part, and a downstream-side breather chamber into which the blow-by gas flows from the upstream-side breather chamber, and the hollow part opens to the chain chamber at a first shaft end portion of the camshaft, and also opens to the downstream-side breather chamber at a second shaft end portion of the camshaft, wherein the first shaft end portion has a diameter larger than that of the second shaft end portion, and further comprising:

a plurality of hole portions having different sizes including a large-sized hole portion and a small-sized hole portion having a cross-sectional area smaller than that of the large-sized hole portion, the plurality of hole portions being aligned in the axial direction to form the hollow part.

12. The internal combustion engine according to claim 11, further comprising:

a baffle portion with which the blow-by gas collides, and which is formed of a step wall between, among the plurality of hole portions, the large-sized hole portion on an upstream side and the small-sized hole portion adjacent to the large-sized hole portion on a downstream side; and an oil recovery hole provided in the camshaft, and opening to the large-sized hole portion in a vicinity of the baffle portion so as to discharge oil in the breather chamber to an outside of the camshaft.

13. The internal combustion engine according to claim 11, further comprising a cam holder which is provided in the cylinder head to rotatably support the camshaft, wherein the downstream-side breather chamber is formed by the cam holder.

14. The internal combustion engine according to claim 11, further comprising a cylindrical member which is provided in the camshaft, and which allows the upstream-side breather chamber and the downstream-side breather chamber to communicate with each other, wherein the cylindrical member includes a bottom wall arranged in the upstream-side breather chamber, and the bottom wall forms a downstream-side baffle portion with which the blow-by gas collides, and wherein the downstream-side breather chamber has a volume-enlarged chamber surrounding and extending in the axial direction beyond the second shaft end portion of the camshaft.

15. The internal combustion engine according to claim 14, wherein the camshaft includes an opening which allows the upstream-side breather chamber and the downstream-side breather chamber to communicate with each other, and which is provided at a position offset from the rotation center line of the camshaft, and the cylindrical member is fitted into the opening.

16. The internal combustion engine according to claim 11, further comprising a decompression system including a decompression shaft operating a decompression element for releasing a compression pressure in a combustion chamber by opening a decompression valve, wherein the decompression shaft is rotatably housed in a housing hole opening to the downstream-side breather chamber at the second shaft end portion.

17. An internal combustion engine comprising:

a cylinder head provided with a pair of engine intake valves;

a valve system including a camshaft provided with a valve cam for opening and closing the engine valves, the camshaft being rotationally driven by power of a crankshaft housed in a crank chamber; and a breather system provided with a breather chamber into which blow-by gas flows through a chain chamber communicating with the crank chamber, wherein the camshaft is provided with a hollow part penetrating of the camshaft in an axial direction of the camshaft, the hollow part having a diameter that is different at different points along an axial length thereof, the breather chamber is constituted of an upstream-side breather chamber formed of the hollow part, and a downstream-side breather chamber into which the blow-by gas flows from the upstream-side breather chamber, and the hollow part opens to the chain chamber at a first shaft end portion of the camshaft, and also opens to the downstream-side breather chamber at a second shaft end portion of the camshaft, and further comprising:

a plurality of hole portions having different sizes including a large-sized hole portion and a small-sized hole portion having a cross-sectional area smaller than that of the large-sized hole portion, the plurality of hole portions being aligned in the axial direction to form the hollow part.

18. The internal combustion engine according to claim 17, further comprising:

a baffle portion with which the blow-by gas collides, and which is formed of a step wall between, among the plurality of hole portions, the large-sized hole portion on an upstream side and the small-sized hole portion adjacent to the large-sized hole portion on a downstream side; and an oil recovery hole provided in the camshaft, and opening to the large-sized hole portion in a vicinity of the baffle portion so as to discharge oil in the breather chamber to an outside of the camshaft.

19. The internal combustion engine according to claim 17, further comprising a cam holder which is provided in the cylinder head to rotatably support the camshaft, wherein the downstream-side breather chamber is formed by the cam holder.

20. The internal combustion engine according to claim 17, further comprising a cylindrical member which is provided in the camshaft, and which allows the upstream-side breather chamber and the downstream-side breather chamber to communicate with each other, wherein the cylindrical member includes a bottom wall arranged in the upstream-side breather chamber, and the bottom wall forms a downstream-side baffle portion with which the blow-by gas collides, and wherein the downstream-side breather chamber has a volume-enlarged chamber surrounding and extending in the axial direction beyond the second shaft end portion of the camshaft.

* * * * *